US006241503B1

(12) United States Patent
Wright et al.

(10) Patent No.: US 6,241,503 B1
(45) Date of Patent: Jun. 5, 2001

(54) SPIN PACK FOR SPINNING MULTIPLE COMPONENT FIBER YARNS

(75) Inventors: Donald E. Wright, Anderson, SC (US); William C. Flynn, III, Hendersonville, NC (US)

(73) Assignee: BASF Corporation, Mt. Olive, NJ (US)

( * ) Notice: Subject to any disclaimer, the term of this patent is extended or adjusted under 35 U.S.C. 154(b) by 0 days.

(21) Appl. No.: 08/650,787

(22) Filed: May 20, 1996

Related U.S. Application Data

(62) Division of application No. 08/472,280, filed on Jun. 7, 1995, now Pat. No. 5,595,699.

(51) Int. Cl.[7] ..... B29C 47/12
(52) U.S. Cl. ..... 425/131.5; 425/198; 425/199
(58) Field of Search ..... 425/197, 199, 425/131.5, 72.2, 382.2, 198; 264/169

(56) References Cited

U.S. PATENT DOCUMENTS

| | | | | |
|---|---|---|---|---|
| Re. 35,108 | | 12/1995 | Hagen et al. . | |
| 3,458,900 | * | 8/1969 | Shinkai et al. | 425/199 |
| 3,488,806 | | 1/1970 | DeCecco et al. . | |
| 3,716,317 | | 2/1973 | Williams, Jr. et al. . | |
| 3,938,924 | * | 2/1976 | Abella et al. | 425/199 |
| 4,842,503 | * | 6/1989 | Judge | 425/72.2 |
| 4,849,103 | * | 7/1989 | Schmidt et al. | 425/199 |
| 5,162,074 | | 11/1992 | Hills . | |
| 5,234,650 | * | 8/1993 | Hagen et al. | 425/131.5 |

FOREIGN PATENT DOCUMENTS

| | | | | |
|---|---|---|---|---|
| 676074 | * | 12/1963 | (CA) | 264/169 |
| 197804 | * | 4/1978 | (DE) | 264/169 |

OTHER PUBLICATIONS

McCabe and Smith, "Unit Operations of Chemical Engineering" p. 342, 1956.*

* cited by examiner

*Primary Examiner*—David A. Simmons
*Assistant Examiner*—Robert A. Hopkins
(74) *Attorney, Agent, or Firm*—Nixon & Vanderhye P.C.

(57) ABSTRACT

A composite yarn formed of at least two different individual polymeric fibers may be spun by directing at least two streams of different polymer melts (e.g., polymer melts of different colors and/or characteristics) to a spin pack such that one of the streams has a greater volumetric throughput as compared to the volumetric throughput of the other stream. The polymer streams are each distributed within the spin pack among individual filtration chambers so that the filtration chambers receive substantially the same volumetric throughput allotment of the polymer melt streams. In such a manner, the polymer melt streams are distributed among the filtration chambers in substantially equal throughput allotments even though the total throughput of the melt streams of each of the different polymers may be unequal. The filtered polymer melt streams may then be directed through fiber-forming orifices of a spinneret plate to form the composite yarn.

4 Claims, 4 Drawing Sheets

SPIN PACK FOR SPINNING MULTIPLE COMPONENT FIBER YARNS

CROSS-REFERENCE TO RELATED PATENTS

This is a Divisional of application Ser. No. 08/472,280, filed Jun. 7, 1995 now U.S. Pat. No. 5,595,699.

This application may be deemed related to prior-issued, commonly owned U.S. Pat. No. 5,162,074 issued on Nov. 10, 1992 to Hills et al entitled "Method of Making Plural Component Fibers", and U.S. Pat. No. 5,234,650 issued Aug. 10, 1993 to Hagen et al entitled "Method for Spinning Multiple Colored Yarn", the entire content of each patent being incorporated expressly herein by reference.

FIELD OF INVENTION

The present invention relates generally to the field of melt extrusion of fiber-forming polymers. More specifically, this invention relates to melt extrusion to form multicomponent (i.e., multicolored) yarn.

BACKGROUND AND SUMMARY OF THE INVENTION

Spin packs which are capable of spinning multiple component fibers are known, for example, through the above-cited Hills et al '074 and Hagen et al '650 patents. One problem that may exist, however, with conventional multiple component spin packs is premature spin pack downtime necessitated by plugging of filter elements associated with the polymer component having the higher throughput. That is, when spinning multiple component fibers, one or more of the individual polymer components (e.g., polymer components of different color) may have a greater spin pack throughput as compared to the spin pack throughput of other individual polymer components. Thus, while the filter elements adequately continue to filter that one (or more) individual polymer component having lesser spin pack throughput, the filter elements which filter the polymer component(s) having the greater polymer throughput have a propensity to clog thereby necessitating spin pack down time for service and/or cleaning. Also, some pigments require more filtration area than others even at the same throughputs.

According to the present invention, however, polymer throughputs of individual polymer components forming a multicomponent polymeric fiber are substantially equalized for purposes of filtration, even though the total throughput of one of the individual polymer components is greater/lesser as compared to the throughput of at least one other polymer component. That is, any unequal throughput of the polymer streams employed to form multiple polymer component yarn is, according to the present invention, equalized for purposes of polymer filtration within the spin pack.

More specifically, according to the present invention, at least two different individual polymeric fibers may be spun by directing at least two streams of different polymer melts (e.g., polymer melts of different colors) to a spin pack such that one of the streams has a greater volumetric throughput as compared to the volumetric throughput of the other stream. The polymer streams are each distributed within the spin pack among individual filtration chambers so that each such filtration chamber receives substantially the same volumetric throughput of the polymer melt streams. In such a manner, the polymer melt streams are distributed among the filtration chambers in substantially equal throughput allotments even though the total throughput of the melt streams of each of the different polymers may be different. The filtered polymer melt streams may then be directed through fiber-forming orifices of a spinneret plate to form the composite yarn.

These and other advantages of the invention will become more clear from the following detailed description of the preferred exemplary embodiment thereof which follows.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
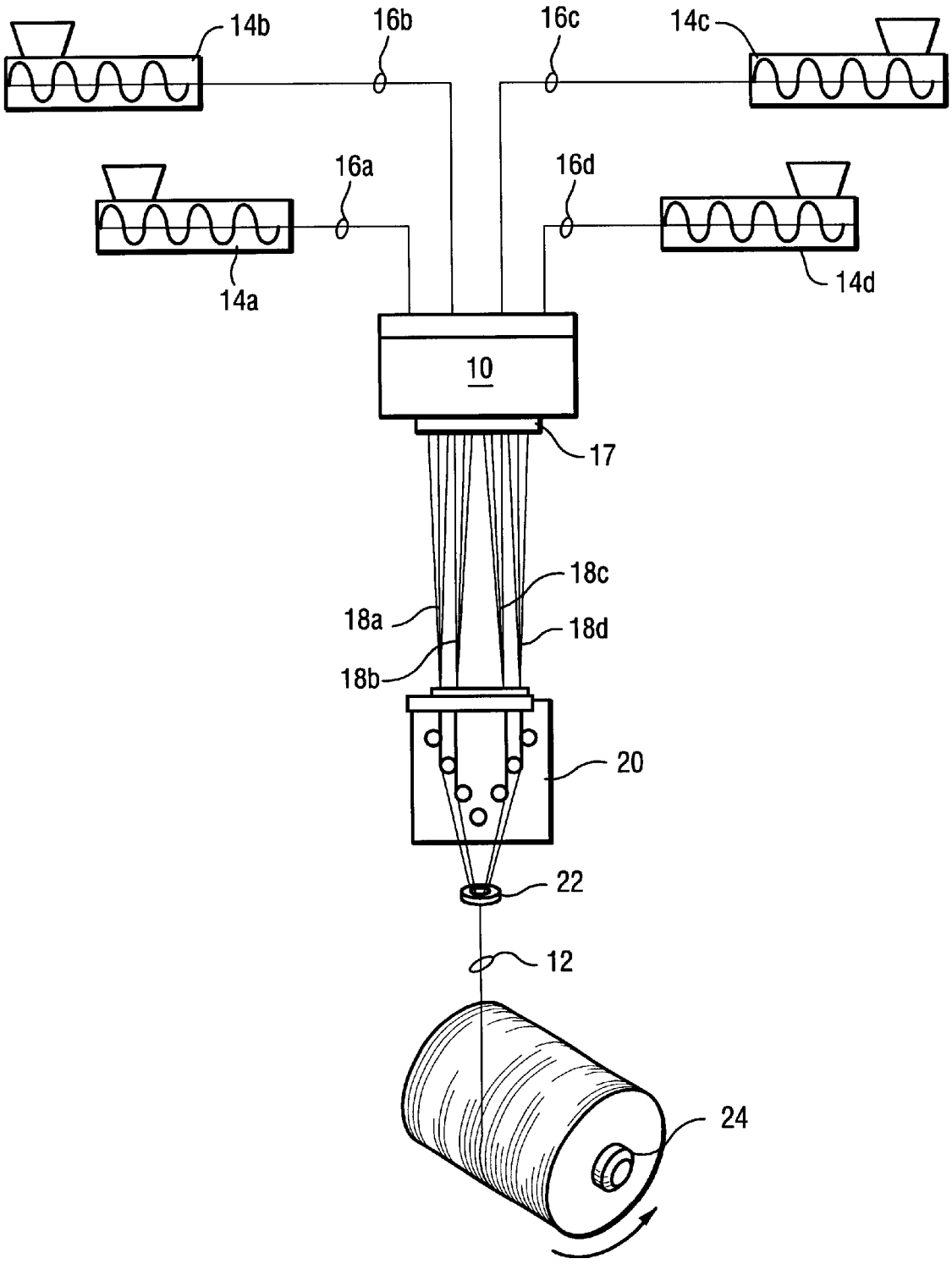
FIG. 1 is a schematic view of a system that may be employed to spin a multiple component yarn.

Accompanying FIG. 1 shows a exemplary system in which the spin pack 10 according to this invention may be employed so as to form a multiple component yarn 12. More specifically, individual different polymer components are rendered molten by extruders 14*a*–14*d* and introduced into the spin pack 10 via lines 16*a*–16*d*, respectively. The molten polymer components will be extruded through individual orifices each having respective individual back holes associated spinneret plate 17 of the spin pack 10. Thus, individual fiber streams 18*a*–18*d* corresponding respectively to the individual polymer components will be issued from the spinneret plate 17. The individual fibers may thus be directed over a suitable guide structure 20 and gathered at ring 22 so as to form the multiple component yarn 12 which is taken up on a bobbin 24.

As may be appreciated, if the individual polymer streams 16*a*–16*d* are constituted by individual differently colored molten polymers, then the yarn 12 which is formed downstream of the spinneret will be a composite of the individual differently colored fibers. Therefore, by increasing/decreasing the number of individual fibers of one color in the yarn 12, a different visual color hue or characteristic (e.g., a "heather-type" yarn) will be achieved. This different visual color hue or characteristic may thus be achieved by the techniques generally described in the above-mentioned Hagen et al '650 patent—that is, by providing the means for selecting which, if any, mutually separated molten polymer in the streams 16*a*–16*d* flows into which orifice backhole of the spinneret 17. Thus, it is entirely possible (and in fact typical) for one of the polymer streams 16*a*–16*d* to be introduced at a greater throughput as compared to others of the polymer streams 16*a*–16*d*.

According to the present invention, however, the unequal throughput of the polymer streams 16*a*–16*d* is equalized for purposes of polymer filtration within the spin pack 10. This filtration throughput equalization is preferably accomplished using the structures depicted in accompanying FIGS. 2–4.

Figure 3:
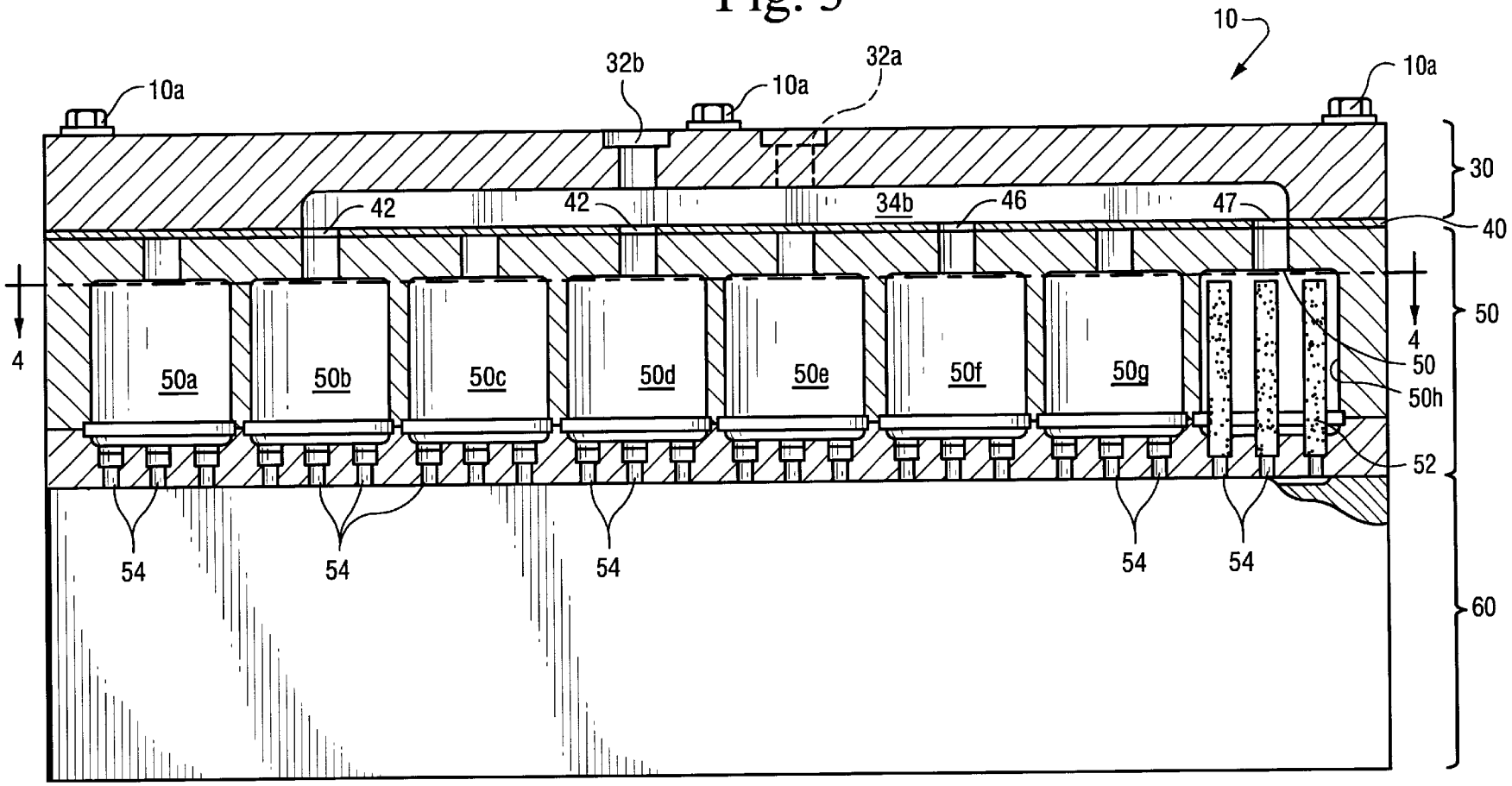
FIG. 3 is a partial cross-sectional elevational view of the spin pack shown in FIG. 2 as taken along line 3—3 therein.

As seen particularly in FIG. 3, the spin pack 10 according to the exemplary embodiment depicted therein includes a manifold plate 30, a distribution plate 40, a filtration housing 50 and a selection assembly 60 formed of one or more selection plates as described more fully in the above-cited Hagen et al '650 patent. These structural components are sandwiched together to form the spin pack 10 using bolt assemblies 10*a*.

Figure 2:
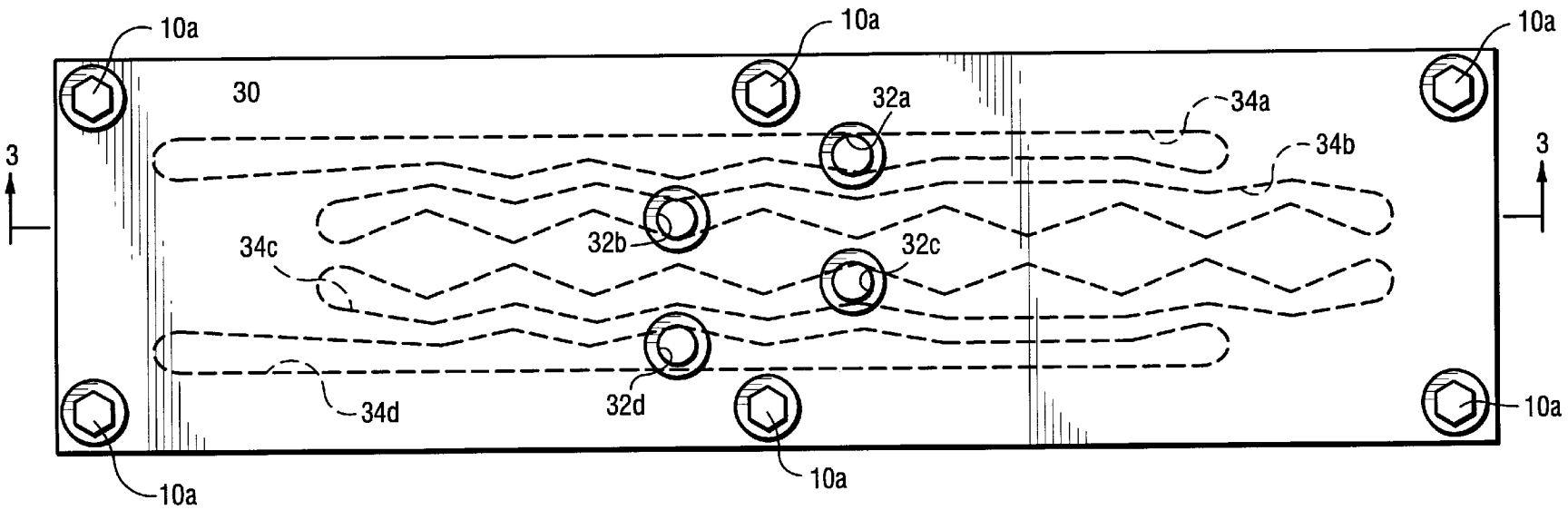
FIG. 2 is a top plan view of a particularly preferred spin pack embodiment according to the present invention.

As is perhaps best shown by FIG. 2, the manifold plate 30 includes polymer ports 32*a*–32*d* which receive molten polymer as an input from polymer streams 16*a*–16*d*, respectively. Each of the ports 32*a*–32*d* communicates with a respective one of the polymer distribution channels 34*a*–34*d*, respectively, formed in the bottom surface of the manifold plate 30.

The distribution channels 34*a*–34*d* extend so as to be capable of communication with respective groupings of filtration chambers 50*a*–50*p*. Selective communication between the distribution channels 34*a*–34*d* and selected ones of the filtration chambers 50*a*–50*p* is established by apertures associated with the distribution plate 40. For example, as shown in FIG. 3, the distribution plate 40 includes four apertures 42, 44, 46 which direct molten polymer from the distribution channel 34*b* into only four of the equal volume filtration chambers 50*a*–50*p* formed in the selection assembly 50—that is, into filtration chambers 50*b*, 50*d*, 50*f* and 50*h*, respectively. Similarly, the distribution plate 40 will include additional apertures in fluid communication with all of the remaining channels 34*a*, 34*c* and/or 34*d* so as to direct molten polymer into selected ones of the remaining filtration chambers 50*a*, 50*c*–50*e*, 50*g* and/or 50*i*–50*p* as may be desired for a given yarn product.

In other words, the location and number of apertures in the distribution plate 40 will allow the polymer throughput for a given molten polymer to be divided evenly among one or more of the filtration chambers 50*a*–50*p* so that the polymer throughput relative to any given one of the filtration chambers 50*a*–50*p* is substantially equivalent to the polymer throughput relative to any other one of the filtration chambers 50*a*–50*p*. As a specific example, if molten polymer entering the spin pack via ports 32*a*, 32*d* each represents twice the throughput as compared to polymer entering the spin pack via ports 32*b*, 32*c*, then the apertures must be formed in the distribution plate 40 so that each such polymer stream is distributed among twice the number of filtration chambers 50*a*–50*p* as compared to the number of filtration chambers 50*a*–50*p* to which the polymers entering the spin pack via ports 32*b*, 32*c* is distributed.

Figure 4:
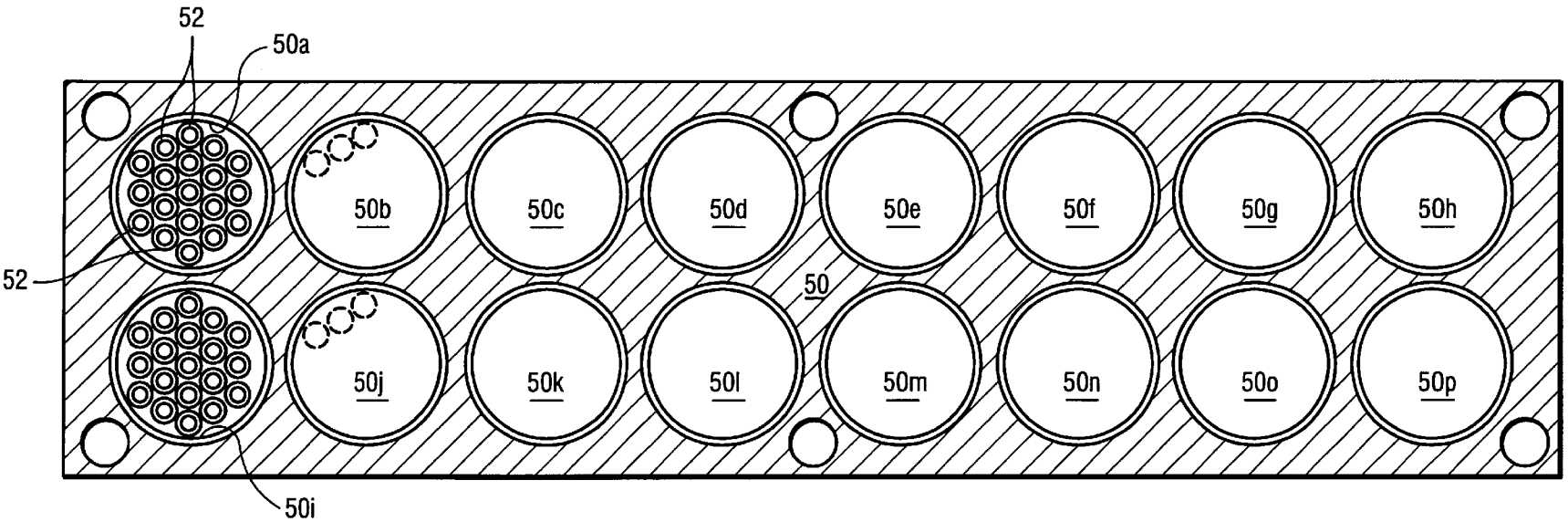
FIG. 4 is a cross-sectional plan view of the spin pack shown in FIG. 3 as taken through the individual filtration chambers along line 4—4 therein.

In any case, the molten polymer is filtered through a number of individual candle filters provided in each of the filtration chambers 50*a*–50*b*, a few such candle filters being shown in FIGS. 3 and 4 by reference numeral 52. Once the filtered polymer exits the filtration chambers 50*a*–50*p* through individual outlet channels 54 associated with each of the candle filters 52, the filtered polymer may then be recombined as needed by the channels (not shown) formed within the selection assembly 60 as described more fully in the above-cited Hagen et al '650 patent. As such, the filtered polymer streams may be directed to the orifices in the spinneret plate 17 (see FIG. 1) in virtually any desired pattern and/or order.

As should now be appreciated, a principal functional attribute of this invention allows polymer streams of unequal throughput to be subjected to substantially equalized throughput for purposes of filtration. In addition, more uniform polymer residence time within the filtration chambers may be achieved. This substantial equalization of polymer throughput and/or more uniform polymer residence time therefore allows each of the filter elements (e.g., the candle filters 52) to be individually exposed to substantially the same volume of polymer melt per unit time thereby decreasing the likelihood that the filter elements will become prematurely plugged (which could otherwise be the case if some of the filter elements were required to filter an unequal volume of polymer melt per unit time as compared to other filter elements).

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A spin pack for spinning composite yarn having at least two different individual polymer fiber components, comprising:

a filtration plate which defines a plurality of equal volume filtration chambers, each said filtration chamber having a filter element disposed therewithin;

a manifold plate having at least one and another distribution channels for receiving at least first and second different polymer melt flows having lesser and greater volumetric throughputs, respectively, to be spun into said at least two different individual polymer fiber components and for directing the at least first and second different polymer melt flows to respective separate first and second groups of said filtration chambers;

a distribution plate interposed between said filtration and manifold plates having (1) at least one aperture for establishing communication between said one distribution channel of said manifold plate and at least one of the filtration chambers of said first group thereof so as to direct said polymer melt flow having said lesser volumetric throughput through said at least one filtration chamber of said first group, and (2) a plurality of other apertures for establishing communication between said another distribution channel of said manifold plate and a corresponding plurality of filtration chambers of said second group thereof so as to direct said polymer melt flow having said greater volumetric throughput through said plurality of filtration chambers of said second group, whereby the volumetric throughputs of said first and second polymer flows is essentially equalized through said first and second groups of filtration chambers; and a spinneret plate for receiving said first and second polymer melt streams filtered through said filtration chambers of said first and second groups thereof and for spinning the different individual polymer fiber components.

2. The spin pack as in claim 1, wherein each said filtration chamber includes a plurality of candle filters.

3. The spin pack as in claim 1, further comprising a selection assembly disposed between said filtration and spinneret plates for directing polymer melt flow allotments discharged from said filtration chambers to respective orifices formed in said spinneret plate.

4. The spin pack as in claim 1, wherein said distribution plate has at least two apertures for distributing polymer melt flow allotments to at least two respective non-adjacent filtration chambers.

* * * * *